US009133700B2

(12) United States Patent
Lissianski et al.

(10) Patent No.: US 9,133,700 B2
(45) Date of Patent: Sep. 15, 2015

(54) $CO_2$ FRACTURING SYSTEM AND METHOD OF USE

(71) Applicant: General Electric Company, Schenectady, NY (US)

(72) Inventors: Vitali Victor Lissianski, Schenectady, NY (US); Stephen Duane Sanborn, Copake, NY (US); Andrew Jacob Gorton, Saratoga Springs, NY (US)

(73) Assignee: General Electric Company, Niskayuna, NY (US)

( * ) Notice: Subject to any disclaimer, the term of this patent is extended or adjusted under 35 U.S.C. 154(b) by 248 days.

(21) Appl. No.: 13/690,074

(22) Filed: Nov. 30, 2012

(65) Prior Publication Data

US 2014/0151051 A1 Jun. 5, 2014

(51) Int. Cl.

| | |
|---|---|
| ***E21B 43/26*** | (2006.01) |
| ***E21B 43/267*** | (2006.01) |
| ***E21B 43/16*** | (2006.01) |
| ***E21B 21/06*** | (2006.01) |

(52) U.S. Cl.

CPC ..... *E21B 43/267* (2013.01); *E21B 21/062* (2013.01); *E21B 43/164* (2013.01)

(58) Field of Classification Search

CPC ..... E21B 43/267; E21B 43/25; E21B 43/164; E21B 43/26

USPC ..... 166/308.1, 308.2, 177.5

See application file for complete search history.

(56) References Cited

U.S. PATENT DOCUMENTS

| | | | |
|---|---|---|---|
| 2,875,833 | A | 3/1959 | Martin |
| 4,701,270 | A | 10/1987 | Bullen et al. |
| 5,002,125 | A | 3/1991 | Phillips et al. |
| 5,069,283 | A | 12/1991 | Mack |

(Continued)

FOREIGN PATENT DOCUMENTS

| | | | |
|---|---|---|---|
| CA | 1134258 | A1 | 10/1982 |
| FR | 2808223 | A1 | 11/2001 |
| WO | 2011044260 | A3 | 9/2011 |

OTHER PUBLICATIONS

McKenna, "Fracking Could be Combined with Carbon Capture Plans", Newscientist, Aug. 2012.

(Continued)

*Primary Examiner* — Brad Hacourt

(74) *Attorney, Agent, or Firm* — Francis T. Coppa

(57) ABSTRACT

An apparatus and method for delivering a thickened fluid mixture, including a $CO_2$ recapture system. The apparatus including a proppant storage vessel and a fracturing fluid storage vessel providing a continuos supply of a proppant material and a fracturing fluid to a mixing apparatus. The mixing apparatus configured to output and deliver a thickened fluid mixture of the proppant, the fracturing fluid and a thickener agent at or above the fracturing fluid blending pressure to a high pressure pump assembly. The high pressure pump assembly configured to deliver a high pressure thickened fluid mixture to one or more downstream components at an injection pressure. The apparatus including a $CO_2$ recapture system configured to recapture an exhaust stream from the one or more downstream components and/or other $CO_2$ output sources, and provide a purified and liquefied $CO_2$ fluid stream to the fracturing fluid storage vessel. The apparatus configured for continual operation.

20 Claims, 4 Drawing Sheets

(56) References Cited

U.S. PATENT DOCUMENTS

| | | | | |
|---|---|---|---|---|
| 5,515,920 | A * | 5/1996 | Luk et al. | 166/280.1 |
| 6,306,800 | B1 | 10/2001 | Samuel et al. | |
| 6,439,310 | B1 | 8/2002 | Scott et al. | |
| 6,955,704 | B1 | 10/2005 | Strahan | |
| 7,252,700 | B1 | 8/2007 | Strahan | |
| 7,677,317 | B2 | 3/2010 | Wilson | |
| 2003/0019627 | A1 * | 1/2003 | Qu et al. | 166/281 |
| 2010/0077752 | A1 | 4/2010 | Papile | |
| 2011/0209882 | A1 | 9/2011 | Enis et al. | |
| 2012/0067568 | A1 | 3/2012 | Palmer et al. | |
| 2013/0118735 | A1 * | 5/2013 | Jamal et al. | 166/266 |

OTHER PUBLICATIONS

Enick et al., "Mobility and Conformance Control for Carbon Dioxide Enhanced Oil Recovery (CO2-EOR) via Thickeners, Foams, and Gels—A Detailed Literature Review of 40 Years of Research", National Energy Technology Laboratory—U.S. Department of Energy, DOE/NETL-2012/1540, 2012.

International Search Report and Written Opinion issued in connection with corresponding PCT Application No. PCT/US2013/069173 on Oct. 16, 2014.

* cited by examiner

$CO_2$ FRACTURING SYSTEM AND METHOD OF USE

BACKGROUND

Embodiments disclosed herein relate generally to an apparatus and method of delivering a fluid mixture into a wellbore and recapture/recycling of an output $CO_2$.

Hydraulic fracturing, commonly known as hydro fracturing, or simply fracturing, is a technique used to release petroleum, natural gas or other substances for extraction from underground reservoir rock formations. A wellbore is drilled into the reservoir rock formation, and a treatment fluid is pumped which causes fractures and allows for the release of trapped substances produced from these subterranean natural reservoirs. Current wellhead fracturing systems utilize a process wherein a slurry of fracturing fluid and proppant (e.g. sand) is created and then pumped into the well at high pressure. When water-based fracturing fluids are used, a process referred to as hydro fracturing, the proppant, water and appropriate chemicals can be mixed at atmospheric pressure and then pumped up to a higher pressure for injection into the well. However, if fluids other than water (e.g. liquid $CO_2$ or liquid propane) are used as the fracturing fluid, then these fluids must be kept at a sufficient pressure throughout the hydraulic fracturing system to avoid undesired vaporization. As a result, the blending of these fluids with proppant, chemicals, etc. must also be accomplished while the fluids are kept under a sufficiently high pressure.

$CO_2$ fracturing, a water-free fracturing technique, avoids many of the environmental problems associated with hydro fracturing such as soil contamination due to top-side fluid spills and use of clean drinking water sources. In addition, hydrocarbon production can be improved through reduced damage to the formation and proppant pack, yet several factors limit commercial application. Such factors include cost of $CO_2$, availability of $CO_2$, flaring of $CO_2$ and effective proppant transport to name a few. $CO_2$ as a fracturing fluid must be injected at the well site as a supercritical liquid. Typically, $CO_2$ fracturing operations provide that the $CO_2$ is delivered from an external source, stored on site and blended with proppant under pressure. Current $CO_2$ fracturing processes utilize pressurized proppant blending and storage of the amount of proppant required to complete a single fracturing stage under pressure to support blending, which limits both proppant and $CO_2$ storage capacities. During clean-up and flow-back of the well, the $CO_2$ is typically vented/flared to the atmosphere.

Known pressurized blenders capable of blending vaporizing fracturing fluids, such as $CO_2$, with the proppant at a suitably high pressure utilize a pressurized proppant storage vessel arrangement to feed and meter the proppant into the pressurized fracturing fluid. These known lock-hopper based pressurized blenders require pre-loading with the proppant to be utilized during a given fracture stage. The pressurized proppant storage vessels used typically have a capacity in the range of approximately 20-40 tons of proppant (e.g., sand). The limited volume capacity of the proppant storage vessel system provides for limited amounts of proppant to be blended with the $CO_2$ fracturing fluid. In addition, these known pressurized blenders require an undesirably long elapsed time to reload them with proppant for the next fracture stage. In some instances, some pressurized blender operations require the blender unit be moved off-site to another location for the purpose of reloading with proppant, also requiring an undesirably long time and potentially adding to the truck traffic associated with fracturing operations.

In many instances, the limited capacity requires specialized logistics and on-pad (or off-pad) proppant handling equipment to be used in conjunction with the proppant storage vessel based pressurized blenders.

As a result of the limited capacity of the proppant under pressure, injection rates and the volume of an output flow of $CO_2$/proppant slurry are limited since blender operation has to be periodically stopped to allow for refilling of proppant storage and/or supplying of $CO_2$. This stoppage in operation results in lost man-hours, or a larger number of blenders on the wellpad, either of which increases costs.

Accordingly, there is a need for an improved $CO_2$ fracturing system and method for delivering fracturing fluid into a wellbore that will enable the blending and pumping of essentially unlimited quantities of proppant and fracturing fluid to form the fluid mixture. The ability to deliver unlimited quantities will provide for continuous operation of the system, enable fracture plans to be based upon reservoir stimulation requirements without imposing equipment constraints, and therefore providing overall a more efficient system.

BRIEF SUMMARY OF THE INVENTION

These and other shortcomings of the prior art are addressed by the present disclosure, which provides an apparatus for delivering a fluid mixture, including a $CO_2$ system.

In accordance with an embodiment, provided is an apparatus for delivering a fluid mixture including a pressurized proppant feed assembly, a fracturing fluid storage vessel, a thickener agent storage vessel, a mixing apparatus, a high pressure pump assembly, recapture system and a separation chamber. The pressurized proppant feed assembly including a proppant storage vessel configured to contain therein a proppant material at ambient pressure and a pump assembly coupled to the proppant storage vessel. The pump assembly is configured to output a proppant output flow at or above a fracturing fluid blending pressure, wherein the fracturing fluid blending pressure is greater than the ambient pressure. The fracturing fluid storage vessel is configured to contain therein a fracturing fluid and output a fracturing fluid output flow at or above the fracturing fluid blending pressure. The thickener agent storage vessel is configured to contain therein a thickener agent. The thickener agent storage vessel in fluid communication with the fracturing fluid output flow. The mixing apparatus is coupled to the pressurized proppant feed assembly and the fracturing fluid storage vessel. The mixing apparatus is in fluid communication with the proppant output flow and the fracturing fluid output flow. The mixing apparatus is configured to mix the proppant output flow, the fracturing fluid output flow and the thickener agent therein and output a thickened fluid mixture of proppant and thickened fracturing fluid at or above the fracturing fluid blending pressure. The high pressure pump assembly is coupled to the mixing chamber and configured to deliver the thickened fluid mixture therein to a downstream component at an injection pressure, wherein the injection pressure is greater than the fracturing fluid blending pressure. The recapture system is configured to receive an output flow from one or more of an exhaust stream from the downstream component, a well flow-back stream, a vented output stream or an external source. The separation chamber is in fluid communication with the recapture system and the fracturing fluid storage vessel.

In accordance with another embodiment, provided is an apparatus for delivering a fluid mixture including a pressurized proppant feed assembly, a $CO_2$ fracturing fluid storage vessel, a thickener agent storage vessel, a mixing apparatus, a high pressure pump assembly, $CO_2$ recapture system and a $CO_2$ separation chamber. The pressurized proppant feed assembly including a proppant storage vessel configured to contain therein the proppant material at ambient pressure and a pump assembly coupled to the proppant storage vessel. The pump assembly is configured to receive a continual supply of proppant material and output a continuous proppant output flow at or above a fracturing fluid blending pressure, wherein the fracturing fluid blending pressure is greater than the ambient pressure. The $CO_2$ fracturing fluid storage vessel is configured to contain therein a $CO_2$ fracturing fluid and output a $CO_2$ fracturing fluid output flow at or above the fracturing fluid blending pressure. The thickener agent storage vessel is configured to contain therein a thickener agent. The thickener agent storage vessel is in fluid communication with the $CO_2$ fracturing fluid output flow. The mixing apparatus is coupled to the pressurized proppant feed assembly and the $CO_2$ fracturing fluid storage vessel. The mixing apparatus is in fluid communication with the proppant output flow and the $CO_2$ fracturing fluid output flow. The mixing apparatus is configured to receive and mix a continual supply of the proppant output flow and a continual supply of the fracturing fluid output flow and output a thickened fluid mixture of proppant and thickened $CO_2$ fracturing fluid at or above the fracturing fluid blending pressure. The high pressure pump assembly is coupled to the mixing chamber and configured to deliver the thickened fluid mixture therein to a downstream component at an injection pressure, wherein the injection pressure is greater than the fracturing fluid blending pressure. The $CO_2$ recapture system is configured to receive a $CO_2$ output flow from one or more of an exhaust stream from the downstream component, a well flow-back stream, a vented $CO_2$ stream or an external source. The $CO_2$ separation chamber is in fluid communication with the $CO_2$ recapture system and the $CO_2$ fracturing fluid storage vessel.

In accordance with yet another embodiment, provided is a method of delivering a fluid mixture, comprising: providing an input of a proppant material at ambient pressure to a proppant storage vessel, providing an input of a fracturing fluid at or above a fracturing fluid blending pressure to a fracturing fluid storage vessel, inputting a proppant output flow at ambient pressure from the proppant storage vessel into a pump assembly wherein the pressure of the proppant output flow is increased to at or above a fracture blending pressure; mixing the proppant output flow, the fracturing fluid output flow and a thickener agent, in a mixing apparatus and outputting a fluid mixture of a thickened fluid mixture at or above the fracturing fluid blending pressure; increasing the pressure of the output thickened fluid mixture in a high pressure pump; delivering the high pressure thickened fluid mixture to one or more downstream components; recapturing $CO_2$ from one or more of an exhaust stream of the one or more downstream components, a $CO_2$ vent stream of the one or more downstream components, a well flow-back stream, or an external $CO_2$ source; separating and purifying the recaptured $CO_2$ to output a purified and liquefied $CO_2$; and delivery of the purified and liquefied $CO_2$ to the a fracturing fluid storage vessel. The proppant storage vessel is configured to output a proppant output flow at ambient pressure; providing an input of a fracturing fluid at or above a fracturing fluid blending pressure to a fracturing fluid storage vessel. The fracturing fluid storage vessel is configured to output a fracturing fluid output flow at or above the fracturing fluid blending pressure.

Other objects and advantages of the present disclosure will become apparent upon reading the following detailed description and the appended claims with reference to the accompanying drawings.

BRIEF DESCRIPTION OF THE FIGURES

The above and other features, aspects, and advantages of the present disclosure will become better understood when the following detailed description is read with reference to the accompanying drawings in which like characters represent like parts throughout the drawings, wherein.

DETAILED DESCRIPTION

The invention will be described for the purposes of illustration only in connection with certain embodiments; however, it is to be understood that other objects and advantages of the present disclosure will be made apparent by the following description of the drawings according to the disclosure. While preferred embodiments are disclosed, they are not intended to be limiting. Rather, the general principles set forth herein are considered to be merely illustrative of the scope of the present disclosure and it is to be further understood that numerous changes may be made without straying from the scope of the present disclosure.

Preferred embodiments of the present disclosure are illustrated in the figures with like numerals being used to refer to like and corresponding parts of the various drawings. It is also understood that terms such as "top", "bottom", "outward", "inward", and the like are words of convenience and are not to be construed as limiting terms. It is to be noted that the terms "first," "second," and the like, as used herein do not denote any order, quantity, or importance, but rather are used to distinguish one element from another. The terms "a" and "an" do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity).

As used herein, the process of forming of a fluid mixture includes mixing a fluid with a powdered or particulate material, such as proppant, a powdered dissolvable or a hydratable additive (prior to hydration). In a continuous treatment or in a continuous part of a well treatment, the fluids are handled as fluid streams.

Figure 1:
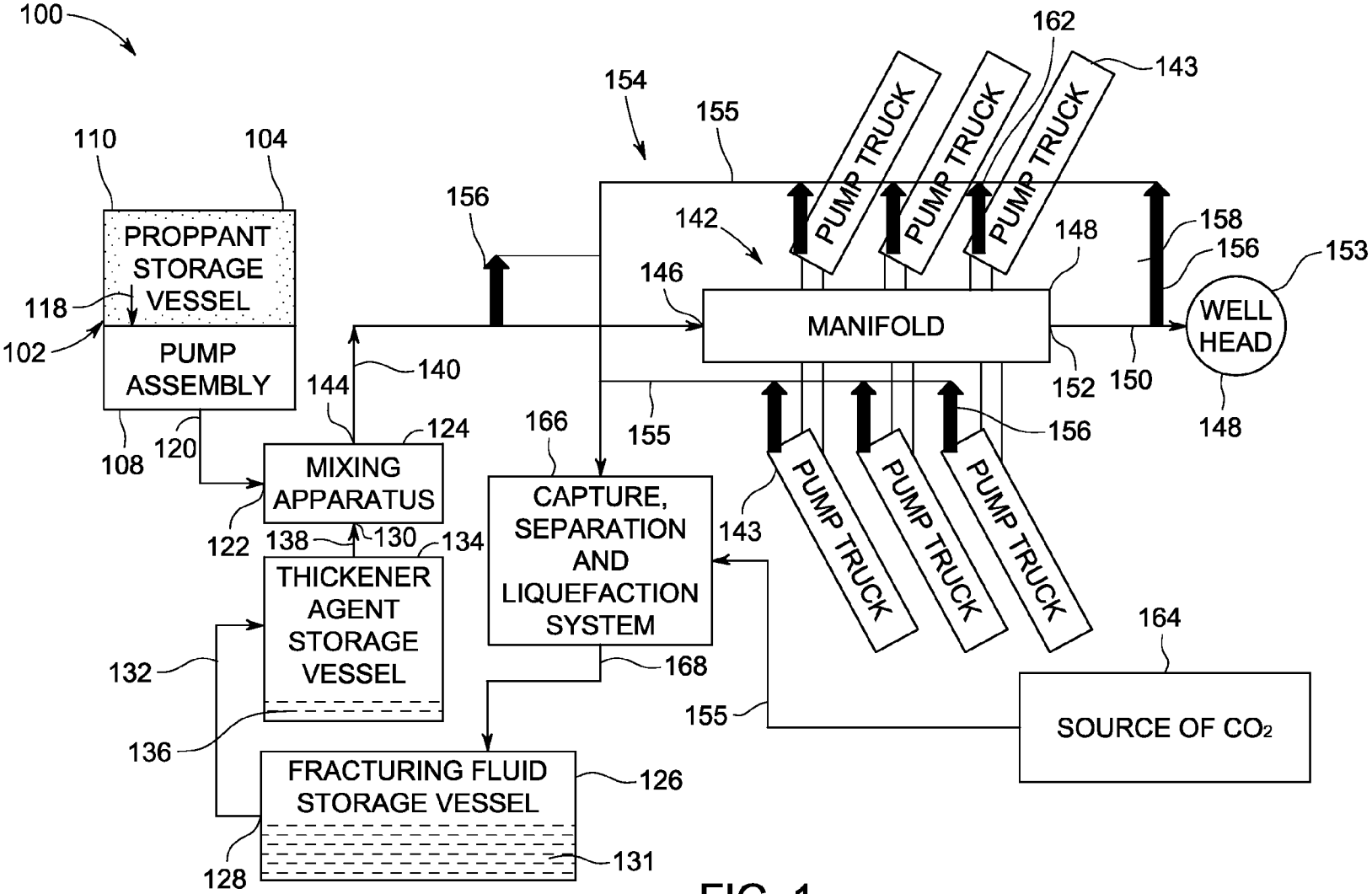
FIG. 1 is a schematic diagram of an apparatus for delivering a fluid mixture, including $CO_2$ recapture, constructed in accordance with an embodiment.

Referring to the drawings wherein, as previously stated, identical reference numerals denote the same elements throughout the various views, FIG. 1 depicts in a simplified block diagram, elements of an apparatus for delivering a fluid mixture 100 including $CO_2$ recapture, according to an embodiment. Again, it should be understood that while the apparatus is described as including $CO_2$ recapture capabilities, alternate fracturing fluids, and subsequent recapture, are anticipated by this disclosure, including, but not limited to, liquid propane, or any fracturing fluid candidate that requires pressurized blending, or that will benefit from vent or flow-back capture, separation, liquefaction, etc.

The apparatus 100 includes a pressurized proppant feed assembly 102, including a proppant storage vessel 104 configured to contain therein a proppant material 106 at ambient pressure and a pump assembly 108 coupled to the proppant storage vessel 104. The proppant storage vessel 104 is coupled to the pump assembly 108, such as a solid feed assembly, at an inlet port of the pump assembly 108. More specifically, an outlet (not shown) of the proppant storage vessel 104 is configured in flow communication with the inlet (not shown) of the pump assembly 108. The proppant storage vessel 104 is configured as a traditional unpressurized storage type vessel and includes a body 110 configured to hold the proppant material 106 therein at atmospheric pressure. The proppant storage vessel 104 may further include a proppant material inlet (not shown) coupled to a proppant material loading device and a source of proppant material (not shown). In an embodiment, the proppant material 106 may be comprised of sand, or other material commonly utilized as proppant in hydraulic fracturing operations. The proppant storage vessel 104 provides adequate storage and loading capabilities to allow for a continuous supply of the proppant material 106 to the pump assembly 108. Example pump assemblies are provided in U.S. pending patent application Ser. No. 13/689,873, filed on the same day herewith and assigned to the same assignee, which is incorporated by reference herein in its entirety During operation, the proppant storage vessel 104 may be loaded by the material loading device, such as a screw auger, conveyor, or any other low pressure means configured to move the proppant material 106 from a proppant supply source (not shown) such as a Sand King® typically used in today's fracing processes to the proppant storage vessel 104. Alternate means for providing the proppant material 106 to the proppant storage vessel 104 are anticipated herein.

The pump assembly 108 is capable of receiving a proppant output flow 118 at atmospheric pressure and providing a proppant output flow 120 at or above a fracturing fluid blending pressure, wherein the fracturing fluid blending pressure is greater than the ambient pressure. In an embodiment, the fracturing fluid blending pressure is in a range of about 150 psi to 400 psi, and preferably at a pressure of approximately 300 psi. The inclusion of the pump assembly 108 in apparatus 100 will allow unlimited amounts of the proppant material 106 to be blended with a fracturing fluid (described presently), using conventional sand logistics and on-pad handling equipment. Accordingly, the pump assembly 108 is capable of operating continuously, in contrast to semi-batch operating modes of the state of the art lock hoppers.

A pressurized blender, or mixing apparatus, 124 is configured to receive the proppant output flow 120 via a proppant inlet 122. A fracturing fluid storage vessel 126 is provided in fluid communication via an outlet 128 with the pressurized mixing apparatus 124, and more particularly via a fracturing fluid inlet 130. The fracturing fluid storage vessel 126 is configured for storage of a fracturing fluid 131 at a required temperature and storage pressure, and more particularly at or above the fracture blending pressure. In an embodiment, the fracturing fluid 131 is $CO_2$. The fracturing fluid storage vessel 126 is further configured to output a fracturing fluid output flow 132 at or above the fracturing fluid blending pressure.

In the illustrated embodiment, the apparatus 100 further includes a thickener agent storage vessel 134 configured to contain therein a thickener agent 136. The thickener agent storage vessel 134 is in fluid communication with the fracturing fluid output flow 132. In the illustrated embodiment, the thickener agent 136 is combined with the fracturing fluid output flow 132, such as $CO_2$, for the purpose of increasing the viscosity of the fracturing fluid and improving proppant transport, thereby achieving fracture widths conducive to hydrocarbon production. The addition of the thickener agent 136 with the fracturing fluid output flow 132 provides a thickened fracturing fluid output flow 138. The pressurized mixing apparatus 124 is configured to receive the thickened fracturing fluid output flow 138 at or above the fracturing fluid blending pressure via the inlet 130.

During operation, the proppant output flow 120 and the thickened fracturing fluid output flow 138 are blended, or mixed, within the pressurized mixing apparatus 124. After mixing, an output flow is delivered to a high pressure pump assembly 142, as a thickened fluid mixture output flow 140 comprised of the proppant 106 and the thickened fracturing fluid 138 at or above the fracturing fluid blending pressure. The thickened fluid mixture output flow 140 is delivered via an outlet 144 of the pressurized mixing apparatus 124 to an inlet 146 of the high pressure pump assembly 142. In alternate embodiments, a fracturing fluid booster pump (not shown) may be provided inline between the mixing apparatus 124 and the high pressure pump assembly 142, or alternatively provided as part of the functionality of the mixing apparatus 124. In the illustrated embodiment, the high pressure pump assembly 142 is comprised of a plurality of high pressure piston pumps 143 that are configured to deliver the thickened fluid mixture output flow 140 received therein to one or more downstream components 148 at an injection pressure, wherein the injection pressure is greater than the fracturing fluid blending pressure. More specifically, in an embodiment, the high pressure pump assembly 142 is configured to deliver a high pressure thickened fluid mixture output flow 150 via an outlet 152 of the high pressure pump assembly 142 to the one or more downstream components 148, such as a well head 153.

Figure 3:
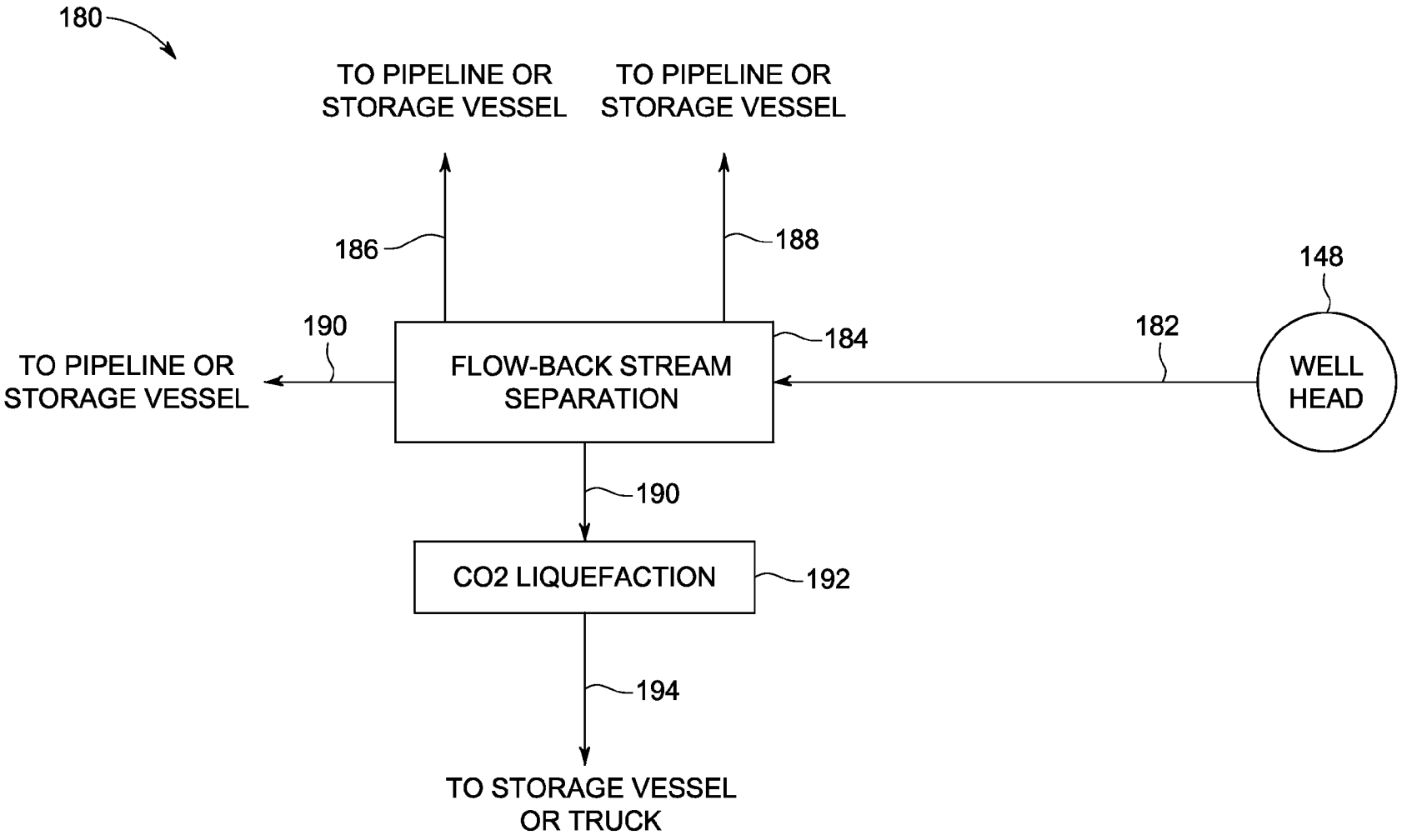
FIG. 3 is a schematic diagram of a portion of an apparatus for recapturing and reusing $CO_2$ from a well flow-back stream.

The apparatus 100 further includes a means for recapturing $CO_2$ so as to further enable continuous operation of the apparatus 100 and to reduce overall costs by reusing the $CO_2$ for other fracture stages. More specifically, a $CO_2$ recapture system 154 including a plurality of pipelines 155 or conduits, is provided and configured to receive a $CO_2$ output flow 156 from one or more of an exhaust stream 158 from the one or more downstream components 148, a well flow-back stream (as shown in FIG. 3), a vented $CO_2$ stream 162 or an external source 164. In an embodiment the $CO_2$ recapture system 154 is configured in fluid communication with a $CO_2$ separation and liquefaction system 166. The $CO_2$ separation and liquefaction system 166 provides for purification of the $CO_2$ in the form of separation and liquefaction of the $CO_2$ output flow 156. Subsequent to processing within the $CO_2$ separation and liquefaction system 166, a purified output flow of $CO_2$ 168 is directed to the fracturing fluid storage vessel 126.

In an alternate embodiment, the separation and liquefying of the recaptured $CO_2$ may be accomplished by an external system that is brought to the well pad on a truck, making the inclusion of the $CO_2$ separation and liquefaction system 166 optional. In addition, the purified and liquefied $CO_2$ may be pumped to one or more $CO_2$ storage containers contained on trucks, or the like, so they can be moved to other well pads, or as illustrated, local $CO_2$ pipelines 155 may be installed for areas with high well pad density.

Providing for the recapture of $CO_2$ from gas streams, such as exhaust gas streams from power generators during the well drilling process, vented gas streams, nearby pad sites where $CO_2$ is captured from natural gas after completion of the well or from equipment exhaust streams, such as frac pumps, generators, or the like, during the fracturing process provides for a continual source of fracturing fluid. This continual source of fracturing fluid, in combination with the above-described providing of a continual source of proppant via the pressurized proppant feed assembly enables a continuous fracturing process to take place.

Figure 2:
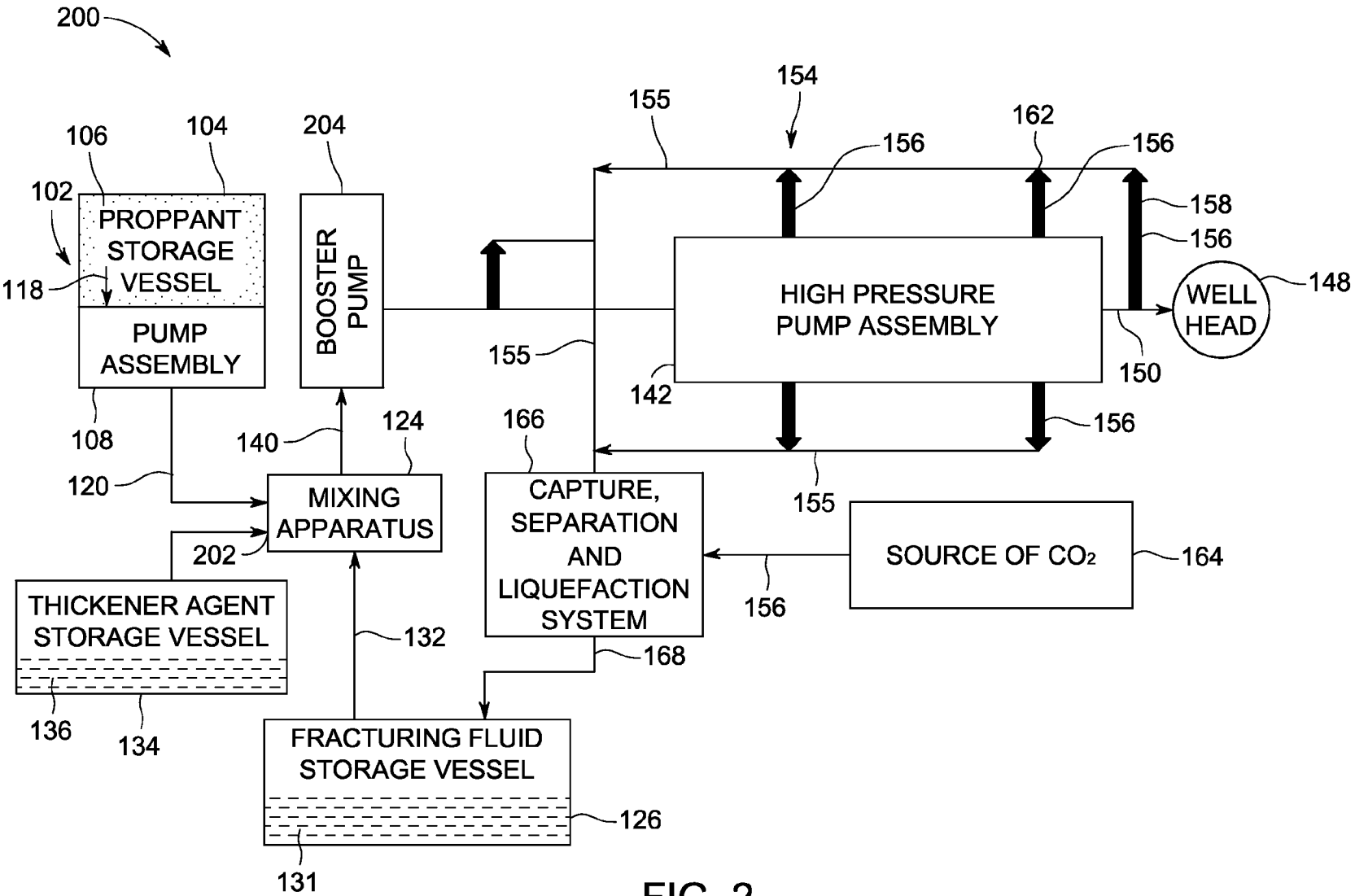
FIG. 2 is a schematic diagram of an apparatus for delivering a fluid mixture, including $CO_2$ recapture, in accordance with another embodiment.

Referring now to FIG. 2, illustrated is an apparatus for delivering a fluid mixture, including a $CO_2$ recapture system, according to an alternate embodiment. More particularly, illustrated is an alternate embodiment whereby, in contrast to the embodiment illustrated in FIG. 1, a thickener agent is provided by direct feed into the mixing apparatus. The embodiment of FIG. 2 addresses the direct delivery of a thickener agent to increase the viscosity of the fracturing fluid, such as thickener agent 136 of FIG. 1, for pressurization and subsequent mixing with the fracturing fluid output flow 132 in a pressurized mixing apparatus 124. The embodiment of FIG. 2 describes an alternate configuration for apparatus 100 and accordingly, like numbers are used to identify like elements throughout the described embodiments. Additionally, in effort to provide a concise description of these embodiments, like features and elements previously described may not be further described.

Referring more specifically to FIG. 2, illustrated is an embodiment of an apparatus for delivering a fluid mixture, including a $CO_2$ recapture, generally referenced 200. The apparatus 200 includes a pressurized proppant feed assembly 102, including a proppant storage vessel 104 configured to contain therein a proppant material 106 and output a proppant output flow 118 at ambient pressure. A pump assembly 108 is provided and coupled to the proppant storage vessel 104. The pump assembly 108 includes a proppant inlet in flow communication with the proppant storage vessel proppant output flow 118. While within the pump assembly 108, the proppant material 106 is subject to pressurization. At the time of discharge, the proppant material output flow 120 is output at an increased pressure, and more particularly at or above a fracture blending pressure that is higher than ambient pressure.

The apparatus 200 further includes a fracturing fluid storage vessel 126 configured to contain therein a fracturing fluid 131 and output a fracturing fluid output flow 132 at or above the fracturing fluid blending pressure. A pressurized blender, or mixing apparatus, 124 is coupled to the pressurized proppant feed assembly 102 to receive the discharged proppant output flow 120 therefrom, to the fracturing fluid storage vessel 126, to receive the discharged fracturing fluid output flow 132 therefrom, and to a thickener agent storage vessel 132, configured to store therein a thickener agent 136. In contrast to the embodiment described with respect to FIG. 1, in this particular embodiment, the thickener agent 136 is input directly into the mixing apparatus 124 via an inlet 202, in lieu of input into the fracturing fluid output flow 132 prior to reaching the mixing apparatus 124.

The mixing apparatus 124 is configured to mix the proppant output flow 120, the fracturing fluid output flow 132 and the thickener agent 136 therein and output a thickened fluid mixture output flow 140 of proppant and thickened fracturing fluid at or above the fracturing fluid blending pressure. A fracturing fluid booster pump 204 and a high pressure pump assembly 142, comprised of a plurality of piston pumps (not shown) are coupled in series, respectively, to the mixing apparatus 124 and configured to deliver a high pressure thickened fluid mixture output flow 150 therein to one or more downstream components 148 at an injection pressure, wherein the injection pressure is greater than the fracturing fluid blending pressure.

The apparatus 200 further includes a means for recapturing $CO_2$ so as to further enable continuous operation of the apparatus 200. More specifically, a $CO_2$ recapture system 154 is provided and configured to receive a $CO_2$ output flow 156 from one or more of an exhaust stream 158 from the one or more downstream components 148, a vented $CO_2$ stream 162 or an external source 164. In addition, as described below with regard to FIG. 3, the system 154 may be configured to deliver a well flow-back stream, upon completion of well head 148, as a $CO_2$ output flow to a storage vessel or an external pipeline flow, if present. The $CO_2$ recapture system 154 may be configured in fluid communication with a $CO_2$ separation and liquefaction system 166 as illustrated in FIG. 2, or in line with a portable separation and liquefaction system, such as a truck mounted system, as previously described. The illustrated $CO_2$ separation and liquefaction system 166 provides for purification and liquefaction of the $CO_2$ output flow 156. Subsequent to processing within the $CO_2$ separation and liquefaction system 166, a purified output flow of $CO_2$ 168 is directed to the fracturing fluid storage vessel 126. In an alternate embodiment, the purified and liquefied $CO_2$ may be pumped to one or more $CO_2$ storage containers contained on trucks, or the like, so they can be moved to other well pads.

Referring more specifically to FIG. 3, illustrated is an embodiment of a well flow-back stream $CO_2$ recapture system 180, as a portion of the $CO_2$ recapture system 154. In the illustrated embodiment, the well flow-back stream $CO_2$ recapture system 180 is configured to deliver a well flow-back stream 182 to a separation system 184 and thereafter tone or more of a liquefaction system 192, a storage vessel or an external pipeline flow, if present. The well flow-back and capture of the $CO_2$, along with the hydrocarbons, occurs after the completion of the wellhead 148. The $CO_2$ will require separation from the other gases, namely methane and other hydrocarbons. After separation of the $CO_2$ it may be stored in a gaseous form or a liquefied form and stored/trucked away or input back into a $CO_2$ pipeline, if one exists. Additional separated well flow-back stream components may be handled similarly as appropriate.

More specifically, as illustrated in FIG. 3, provided is a well flow-back stream 182 generally comprising hydrocarbons (liquid and/or gas), gaseous $CO_2$, water and potentially other gases previously trapped in the subsurface. The well flow-back stream 182 is in fluid communication with a flow-back stream separation system 184. The well flow-back stream separation system 184 is configured to separate the well flow-back stream 182 into one or more of a waste stream 186, a hydrocarbon stream 188, and a gaseous $CO_2$ stream 190. In an embodiment, the waste stream 186 is in fluid communication with one or more of a pipeline or storage vessel. In an embodiment, the hydrocarbon stream 188 is in fluid communication with one or more of a pipeline or storage vessel. In an embodiment, the gaseous $CO_2$ stream 190 is in fluid communication with one or more of a pipeline, storage vessel or a $CO_2$ liquefaction system 192. The $CO_2$ liquefaction system 192 provides for processing of the $CO_2$ in the form of liquefaction of at least a portion of the gaseous $CO_2$ stream 190. More particularly, the $CO_2$ liquefaction system 192 is configured to liquefy the $CO_2$ stream 190 input therein, and output a liquefied $CO_2$ flow stream 194.

Subsequent to processing within the $CO_2$ liquefaction system 192, the liquefied $CO_2$ flow stream 194 is directed to one or more of a storage vessel, such as the fracturing fluid storage vessel 126 of FIGS. 1 and 2, or transported off-site via a truck, or the like. As previously indicated, the flow-back stream 182 from wellhead 148 and capture of the $CO_2$ contained therein, along with the hydrocarbons, occurs subsequent to the completion of the wellhead 148.

Figure 4:
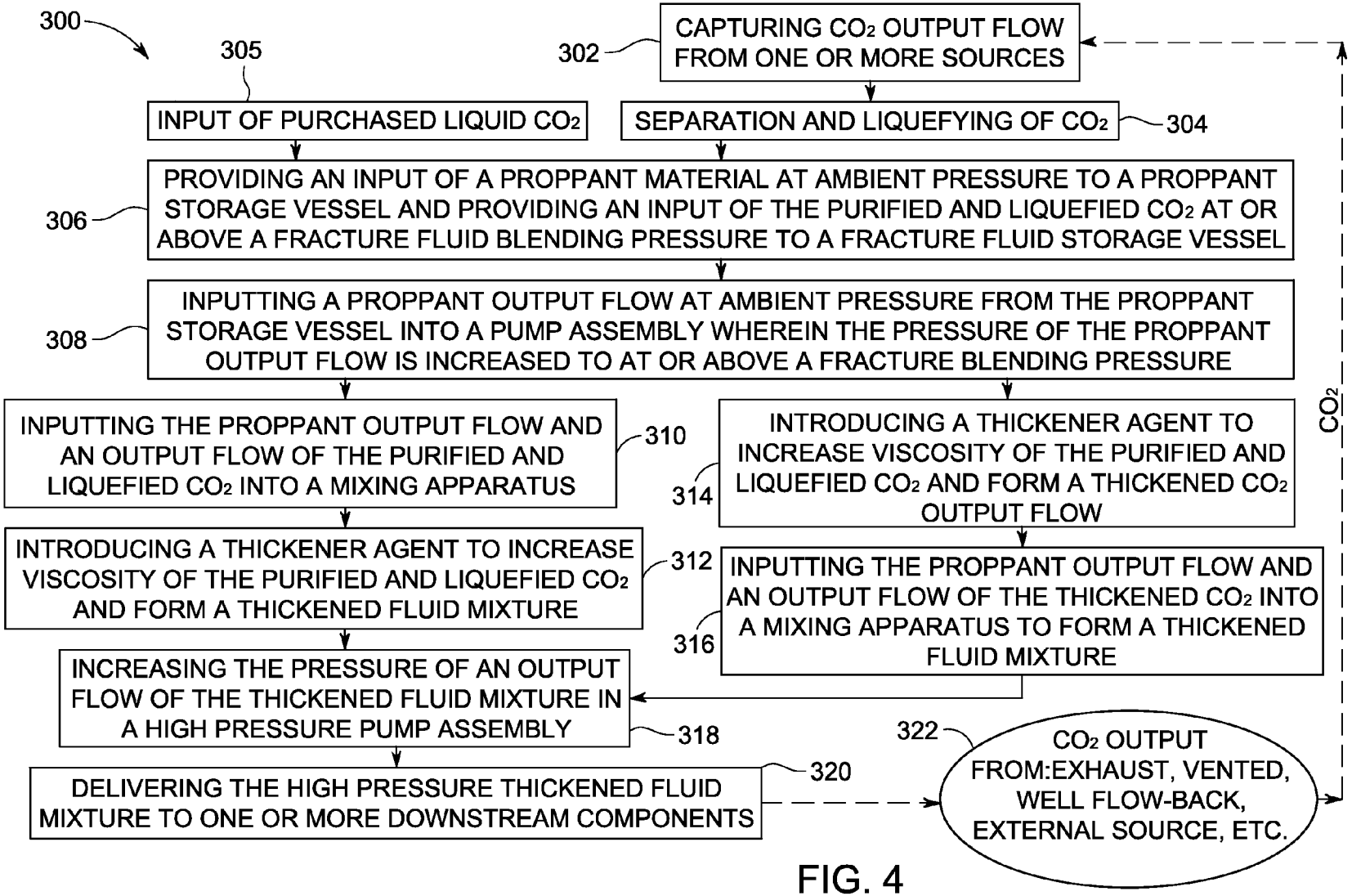
FIG. 4 is a schematic block diagram of a method of delivering a fluid mixture, including $CO_2$ recapture, constructed in accordance with an embodiment.

FIG. 4 is a schematic block diagram of a method 300 of delivering a fluid mixture, including a $CO_2$ recapture system, in an apparatus, such as apparatus 100 or 200 of FIGS. 1 and 2, respectively, according to embodiments disclosed herein. Generally, the method involves capturing $CO_2$ output flow from a gaseous, waste stream source, at step 302. The $CO_2$ is delivered to a separation and liquefying chamber for purification of the $CO_2$, at step 304. In an embodiment, an input of $CO_2$ obtained from an alternate source, such as through purchase, may be additionally, or alternatively, input at step 305. Next, at step 306, the method includes providing an input of a proppant material to a proppant storage vessel and providing an input of a fracturing fluid, and more particularly the purified and liquefied $CO_2$, to a fracturing fluid storage vessel. The proppant material is stored in the proppant storage vessel at ambient pressure. The purified and liquefied $CO_2$ is delivered at or above a fluid blending pressure to the fracturing fluid storage vessel. Next in step 308, a proppant output flow at ambient pressure from the proppant storage vessel is input into a pump assembly. As previously described, the pump assembly provides for an increase in the proppant output flow to at or above a fracture blending pressure. In a first embodiment, as illustrated at step 310, the proppant output flow and an output flow of the fracturing fluid, and more particularly the purified and liquefied $CO_2$, are input to a mixing apparatus. A thickener agent is next added to the mixing apparatus, at step 312, to increase the viscosity of the purified and liquefied $CO_2$. The mixing apparatus, as previously described, is configured to mix the proppant output flow, the fracturing fluid output flow and the thickener agent therein and output a thickened fluid mixture, comprising a thickened $CO_2$/proppant slurry output flow of the proppant and the thickened fracturing fluid ($CO_2$) at or above the fracturing fluid blending pressure.

In an alternate embodiment, the thickener agent is introduced into the fracturing fluid, and more particularly the purified and liquefied $CO_2$, prior to delivery of the fracturing fluid to the mixing apparatus, as best illustrated at step 314. The mixing apparatus, as previously described, and illustrated at step 316, is configured to mix the proppant output flow and the thickened fracturing fluid output flow therein and output a thickened fluid mixture, comprising a thickened $CO_2$/proppant slurry output flow of the proppant and the thickened fracturing fluid ($CO_2$) at or above the fracturing fluid blending pressure.

The pressure of the thickened fluid mixture output flow is next increased in a high pressure pump, at step 318. Subsequently, the high pressure thickened fluid mixture is delivered to one or more downstream components, at a step 320, and ultimately may include delivery to a well head.

During operation, and as previously described, $CO_2$ from one or more of a component exhaust stream, a vented $CO_2$ stream, a well flow-back stream, $CO_2$ provided by external sources, or the like is output at step 322. The output $CO_2$ is recaptured, at step 302, as the process begins again in continuum, as indicated by the dotted line.

Commercial advantages of the disclosed apparatus are related to the current problem faced in unconventional gas development and the requirement to reduce the cost of overall $CO_2$ by reducing waste through recapturing gaseous $CO_2$, mix/blend chemicals and a proppant, namely sand with fracturing fluids (e.g., liquid $CO_2$, liquid propane gas) that require they always be contained at a suitable fracturing fluid blending pressure to avoid vaporization of these fracturing fluids. In addition, commercial advantages of the disclosed apparatus relate to a system configured for continuous operation in light of the providing of a continual proppant source and fracturing fluid, through the recapture of $CO_2$ as described. Accordingly, disclosed is apparatus and method of delivering a fluid mixture using a pump assembly and direct proppant injection into a pressurized mixing apparatus in such a way that a continuous flow of proppant can be provided without being constrained by the total volume limits of the known lock hopper based approaches and the recapture of exhaust, vented, well flow-back, or similar output $CO_2$ in such a way that a continuous flow of fracturing fluid can be provided without being constrained by the total volume limits of the known fracturing fluid storage vessel based approaches.

The foregoing has described an apparatus and method of delivering a fluid mixture using direct injection of a proppant into a pressurized mixing apparatus and $CO_2$ recapture. While the present disclosure has been described with respect to a limited number of embodiments, those skilled in the art, having benefit of this disclosure, will appreciate that other embodiments may be devised which do not depart from the scope of the disclosure as described herein. While the present disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out the disclosure. It is, therefore, to be understood that the appended claims are intended to cover all such modifications and changes as fall within the true spirit of the disclosure.

The invention claimed is:

1. An apparatus for delivering a fluid mixture comprising:

a pressurized proppant feed assembly, the assembly including a proppant storage vessel configured to contain therein a proppant material at ambient pressure and a pump assembly coupled to the proppant storage vessel, the pump assembly configured to output a proppant output flow at or above a fracturing fluid blending pressure, wherein the fracturing fluid blending pressure is greater than the ambient pressure;

a fracturing fluid storage vessel configured to contain therein a fracturing fluid and output a fracturing fluid output flow at or above the fracturing fluid blending pressure;

a thickener agent storage vessel configured to contain therein a thickener agent, the thickener agent storage vessel in fluid communication with the fracturing fluid output flow;

a mixing apparatus coupled to the pressurized proppant feed assembly and the fracturing fluid storage vessel, the mixing apparatus in fluid communication with the proppant output flow and the fracturing fluid output flow, the mixing apparatus configured to mix the proppant output flow, the fracturing fluid output flow, and the thickener agent therein and output a thickened fluid mixture of proppant and thickened fracturing fluid at or above the fracturing fluid blending pressure;

a high pressure pump assembly coupled to the mixing chamber and configured to deliver the thickened fluid mixture therein to a downstream component at an injection pressure, wherein the injection pressure is greater than the fracturing fluid blending pressure;

a recapture system, configured to receive an output flow from one or more of an exhaust stream from the downstream component, a well flow-back stream, a vented output stream or an external source; and a separation and liquefaction system in fluid communication with the recapture system and the fracturing fluid storage vessel.

2. The apparatus of claim 1, wherein the pump assembly is configured to receive a continual supply of proppant material and output a continuous proppant output flow.

3. The apparatus of claim 1, wherein the mixing apparatus is configured to receive a continual supply of the proppant output flow and a continual supply of the fracturing fluid output flow.

4. The apparatus of claim 3, wherein the mixing apparatus is configured to receive a continual supply of the proppant output flow and a continual supply of a thickened fracturing fluid output flow.

5. The apparatus of claim 1, wherein the thickener agent storage vessel is configured to provide direct delivery of the thickener agent to the mixing apparatus.

6. The apparatus of claim 1, wherein the thickener agent storage vessel is configured to provide direct delivery of the thickener agent into the fracturing fluid output flow prior to delivery of the fracturing fluid output flow to the mixing apparatus.

7. The apparatus of claim 1, wherein the fracturing fluid blending pressure is in a range of 150-400 psi.

8. The apparatus of claim 7, wherein the fracturing fluid blending pressure is approximately 300 psi.

9. The apparatus of claim 1, wherein the injection pressure is in a range of 5000-12,000 psi or higher.

10. The apparatus of claim 1, wherein the proppant material is sand.

11. The apparatus of claim 1, wherein the fracturing fluid is liquid $CO_2$.

12. The apparatus of claim 1, wherein the recapture system includes a well flow-back stream recapture system.

13. An apparatus for delivering a fluid mixture comprising:

a pressurized proppant feed assembly, the assembly including a proppant storage vessel configured to contain therein the proppant material at ambient pressure and a pump assembly coupled to the proppant storage vessel, the pump assembly configured to receive a continual supply of proppant material and output a continuous proppant output flow at or above a fracturing fluid blending pressure, wherein the fracturing fluid blending pressure is greater than the ambient pressure;

a $CO_2$ fracturing fluid storage vessel configured to contain therein a $CO_2$ fracturing fluid and output a $CO_2$ fracturing fluid output flow at or above the fracturing fluid blending pressure;

a thickener agent storage vessel configured to contain therein a thickener agent, the thickener agent storage vessel in fluid communication with the $CO_2$ fracturing fluid output flow;

a mixing apparatus coupled to the pressurized proppant feed assembly and the $CO_2$ fracturing fluid storage vessel, the mixing apparatus in fluid communication with the proppant output flow and the $CO_2$ fracturing fluid output flow, the mixing apparatus configured to receive and mix a continual supply of the proppant output flow and a continual supply of the fracturing fluid output flow and output a thickened fluid mixture of proppant and thickened $CO_2$ fracturing fluid at or above the fracturing fluid blending pressure;

a high pressure pump assembly coupled to the mixing apparatus and configured to deliver the thickened fluid mixture therein to a downstream component at an injection pressure, wherein the injection pressure is greater than the fracturing fluid blending pressure;

a $CO_2$ recapture system, configured to receive a $CO_2$ output flow from one or more of an exhaust stream from the downstream component, a well flow-back stream, a vented $CO_2$ stream or an external source; and a $CO_2$ separation and liquefaction system in fluid communication with the $CO_2$ recapture system and the $CO_2$ fracturing fluid storage vessel.

14. The apparatus of claim 13, wherein the thickener agent storage vessel is configured to provide direct delivery of the thickener agent to the mixing apparatus.

15. The apparatus of claim 13, wherein the thickener agent storage vessel is configured to provide direct delivery of the thickener agent into the $CO_2$ fracturing fluid output flow prior to delivery of the $CO_2$ fracturing fluid output flow to the mixing apparatus.

16. The apparatus of claim 13, wherein the fracturing fluid blending pressure is in a range of 150-400 psi and the injection pressure is in a range of 5000-12,000 psi or higher.

17. The apparatus of claim 13, wherein the proppant material is sand.

18. The apparatus of claim 13, further including a well flow-back stream $CO_2$ recapture system.

19. A method of delivering a fluid mixture, comprising:

providing an input of a proppant material at ambient pressure to a proppant storage vessel, the proppant storage vessel configured to output a proppant output flow at ambient pressure;

providing an input of a fracturing fluid at or above a fracturing fluid blending pressure to a fracturing fluid storage vessel, the fracturing fluid storage vessel configured to output a fracturing fluid output flow at or above the fracturing fluid blending pressure;

inputting the proppant output flow at ambient pressure from the proppant storage vessel into a pump assembly wherein the pressure of the proppant output flow is increased to a fracture blending pressure;

mixing the proppant output flow, the fracturing fluid output flow and a thickener agent, in a mixing apparatus and outputting a fluid mixture of a thickened fluid mixture at or above the fracturing fluid blending pressure;

increasing the pressure of the output thickened fluid mixture in a high pressure pump to output a high pressure thickened fluid mixture;

delivering the high pressure thickened fluid mixture to one or more downstream components;

recapturing $CO_2$ from one or more of an exhaust stream of the one or more downstream components, a well flow-back stream, a vented $CO_2$ stream of the one or more downstream components, or an external $CO_2$ source;

separating and liquefying the recaptured $CO_2$ to output a purified and liquefied $CO_2$ stream; and delivery of the purified and liquefied $CO_2$ stream to the a fracturing fluid storage vessel.

20. The method of claim 19, wherein the proppant storage vessel is configured to output a continuous proppant output flow and the fracturing fluid storage vessel is configured to output a continuous fracturing fluid output flow, thereby providing for continuous operation.

* * * * *